US006808599B2

(12) United States Patent
Burazin et al.

(10) Patent No.: US 6,808,599 B2
(45) Date of Patent: Oct. 26, 2004

(54) WIDE WALE TISSUE SHEETS AND METHOD OF MAKING SAME

(75) Inventors: Mark Alan Burazin, Oshkosh, WI (US); Cristina Asensio Muilally, Neenah, WI (US); Andrew Peter Bakken, Appleton, WI (US); Christopher Scott Kowalski, Sherwood, WI (US); Bernhardt Edward Kressner, Appleton, WI (US); Michael Stephen Vance, Appleton, WI (US); Kevin Joseph Vogt, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/633,828

(22) Filed: Aug. 4, 2003

(65) Prior Publication Data

US 2004/0026052 A1 Feb. 12, 2004

Related U.S. Application Data

(62) Division of application No. 10/077,161, filed on Feb. 15, 2002, now Pat. No. 6,673,202.

(51) Int. Cl.[7] ..... D21F 11/00; D21F 13/00

(52) U.S. Cl. ..... 162/123; 162/129; 162/301; 162/300; 162/109

(58) Field of Search ..... 162/123, 129, 162/301, 300, 109

(56) References Cited

U.S. PATENT DOCUMENTS

| | | | | |
|---|---|---|---|---|
| 5,429,686 A | | 7/1995 | Chiu et al. | |
| 5,656,132 A | | 8/1997 | Farrington, Jr. et al. | |
| 5,672,248 A | * | 9/1997 | Wendt et al. | 162/109 |
| 6,039,838 A | | 3/2000 | Kaufman et al. | |
| 2003/0157300 A1 | | 8/2003 | Burazin et al. | |

FOREIGN PATENT DOCUMENTS

| | | |
|---|---|---|
| WO | WO 98/19008 A1 | 5/1998 |
| WO | WO 00/39393 A1 | 7/2000 |

* cited by examiner

*Primary Examiner*—Peter Chin
*Assistant Examiner*—Mark Halpern
(74) *Attorney, Agent, or Firm*—Gregory E. Croft

(57) ABSTRACT

Highly textured tissue sheets, particularly suitable for use as bath tissue, are produced by throughdrying and have a low number and/or low amount of pinholes. The low number or amount of pinholes is provided by using a throughdrying fabric having parallel wide ridges with a height suited to the particular tissue sheet being produced.

4 Claims, 14 Drawing Sheets

WIDE WALE TISSUE SHEETS AND METHOD OF MAKING SAME

This application is a divisional of application Ser. No. 10/077,161 entitled WIDE WALE TISSUE SHEETS AND METHOD OF MAKING SAME, filed in the U.S. Patent and Trademark Office on Feb. 15, 2002 now U.S. Pat. No. 6,675,202. The entirety of application Ser. No. 10/077,161 is hereby incorporated by reference.

BACKGROUND OF THE INVENTION

In the manufacture of tissue roll products, such as bath tissue and paper towels, uncreped throughdried products have gained wide acceptance with consumers. These products are characterized in part by their high bulk, three-dimensional texture and resilience. In the case of paper towels, exceptional bulk is provided by contoured throughdrying fabrics that impart high and wide wales or ridges that run in the machine direction of the product. In the case of bath tissues, the same technology is utilized, but the throughdrying fabrics employed impart a smaller scale topography to the product. While it would be desirable to use the same throughdrying fabric for both towels and bath tissue from the standpoint of manufacturing efficiency, using the more highly contoured towel throughdrying fabric for making bath tissue causes two significant problems.

First, the consumer preferred fiber basis weights and tensile strengths associated with bath tissue products are, for the most part, less than the basis weights and tensile strengths preferred for paper towels. Given the high contour of the fabrics used for paper towel products, the lower basis weights and tensile strengths used for bath tissue products cannot accommodate the substantial z-directional displacement (if the web during wet molding and drying. As a result, the final product contains an unacceptable number of pinholes caused by the web being stretched to conform to the topography of the throughdrying fabric.

In addition, because bath tissue is desirably calendered to control caliper and soften and smoothen the product, the dried web undergoes widening as it is "extruded" from the calender nip. This web widening is amplified as the bulk of the tissue base sheet is increased. This extrusion phenomenon creates inconsistencies during winding, which results in substantial waste and delay.

Therefore there is a need for a method of making highly contoured uncreped throughdried paper towels and bath tissue on the same tissue machine using the same throughdrying fabric.

SUMMARY OF THE INVENTION

It has now been discovered that highly textured bath tissue and paper towels having different basis weights can be made on the same tissue machine using a common throughdrying fabric. This provides manufacturing flexibility by eliminating the need to change throughdrying fabrics whenever switching from bath to towel manufacture or vice versa. It also simplifies fabric purchasing and inventorying.

In one aspect, the invention resides in a papermaking fabric having a textured sheet contacting surface comprising substantially continuous machine-direction ridges separated by valleys, wherein the height of the ridges is from about 0.5 to about 3.5 millimeters, the width of the ridges is about 0.3 centimeter or greater, and the frequency of occurrence of the ridges in the cross-machine direction of the fabric is from about 0.2 to about 3 per centimeter. The fabric can be woven or nonwoven, or a combination of a woven substrate with an extruded sculpture layer providing the ridges.

In another aspect, the invention resides in a continuous method of making bath tissue and paper towels on the same papermaking machine comprising: (a) forming a tissue web having a first basis weight; (b) transferring the tissue web to a throughdrying fabric having substantially continuous machine-direction ridges separated by valleys, wherein the height of the ridges is from about 0.5 to about 3.5 millimeters, the width of the ridges is about 0.3 centimeter or greater and the frequency of the ridges in the cross-machine direction is from about 0.2 to about 3 per centimeter; (c) throughdrying the tissue web; (d) winding the tissue web into a parent roll; (e) converting the parent roll into bath tissue; (f) forming a tissue web having a second basis weight which is greater than the first basis weight; (g) transferring the web to the same throughdrying fabric of step (b); (h) throughdrying the web; (i) winding the dried web into a parent roll; and (j) converting the parent roll into paper toweling.

In another aspect, the invention resides in a tissue sheet having Wide Wales, a basis weight of from about 10 to about 35 grams per square meter (gsm) and one or more of the following pinhole-related indexes: a Pinhole Coverage Index of about 0.25 or less, a Pinhole Count Index of about 65 or less and a Pinhole Size Index of about 600 or less.

In another aspect, the invention resides in a tissue sheet having Wide Wales and a geometric mean tensile strength of from about 500 to about 1200 grams per 7.62 centimeters, a basis weight of from about 10 to about 45 gsm and one or more of the following pinhole-related indexes: a Pinhole Coverage Index of about 0.25 or less, a Pinhole Count Index of about 65 or less and a Pinhole Size Index of about 600 or less. As used herein, "Wide Wales" are a series of parallel ridges on the surface of a tissue sheet which are separated by the lowest areas of the sheet (valleys). The Wide Wales are oriented substantially in the machine direction (MD) of the tissue sheet and impart a surface appearance similar to that of corduroy fabrics. The peaks of the ridges can be relatively flat and the sides of the ridges can be relatively steep. The width of a Wide Wale can be from about 0.3 to about 3.8 centimeters, more specifically from about 0.3 to about 2.0 centimeters; more specifically from about 0.3 to about 1.5 centimeters, more specifically from about 0.3 to about 1.0 centimeter, and still more specifically from about 0.3 to about 0.5 centimeter. The height of a Wide Wale, as measured from the highest point on the ridge to the lowest point on the same side of the sheet between the ridge in question and an adjacent ridge, can be from about 0.5 to about 3.5 millimeters, more specifically from about 0.6 to about 2.0 millimeters, more specifically from about 1.0 to about 2.0 millimeters, more specifically from about 1.0 to about 1.5 millimeters, and still more specifically from about 0.75 to about 1.0 millimeters. The frequency of the 15 occurrence of Wide Wales in the cross-machine direction (CD) of the sheet can be about 0.2 to about 3 per centimeter, more specifically from about 0.2 to about 2 per centimeter, still more specifically from about 1.8 to about 2.3 per centimeter. All of the foregoing dimensions substantially correspond to the dimensions of the ridges and their spacing in throughdrying fabrics from which the tissue sheets are made.

The basis weight of the tissue sheets of this invention can be from about 10 to about 45 gsm, more specifically from about 10 to about 35 gsm, still more specifically from about 20 to about 35 gsm, more specifically from about 20 to about 30 gsm and still more specifically from about 30 to about 35 gsm.

The geometric mean tensile strength (GMT) of the tissue sheets of this invention can be about 1200 grams or less per 7.62 centimeters (hereinafter designated simply as "grams"), more specifically from about 500 to about 1200 grams, still more specifically from about 500 to about 1100 grams, still more specifically from about 800 to about 1000 grams. The GMT is the square root of the product of the MD tensile strength and the CD tensile strength. Tensile strengths are measured using a crosshead speed of 254 millimeters per minute, a full scale load of 4540 grams, a jaw span (gauge length) of 50.8 millimeters and a specimen width of 762 millimeters. A suitable method is disclosed in U.S. Pat. No. 5,656,132 issued Aug. 12, 1997 to Farrington et al., which is herein incorporated by reference.

The ratio of the geometric mean modulus (GMM) to the GMT for tissue sheets of this invention can be about 5 kilometers or less per kilogram, more specifically from about 4 to about 5 kilometers per kilogram. (The GMM is the square root of the product of the MD modulus and the CD modulus.)

The "Caliper" of the products of this invention can be from about 700 to about 1500 microns, more specifically from about 700 to about 1300 microns, and still more specifically from about 750 to about 1100 microns. Caliper is the thickness of a single sheet, but measured as the thickness of a stack of ten sheets and dividing the ten sheet thickness by ten, where each sheet within the stack is placed with the same side up. Caliper is expressed in microns. It is measured using a micrometer having an anvil diameter of 103.2 millimeters and an anvil pressure of 220 grams per square inch (3.3 gram kilopascals. A suitable test method is described in U.S. Pat. No. 5,655,132 issued Aug. 12, 1997 to Farrington et al., previously incorporated by reference. Uncreped throughdried tissue sheets of this invention have a substantially uniform density.

The tissue sheets of this invention can be layered or non-layered (blended). Layered sheets can have two, three or more layers. For tissue sheets that will be converted into a single ply product, it can be advantageous to have three layers with the outer layers containing primarily hardwood fibers and the inner layer containing primarily softwood fibers.

As used herein, the "Pinhole Coverage Index", the "Pinhole Count Index" and the "Pinhole Size Index" are determined by an optical test method which, in conjunction with image processing algorithms, isolates pinholes and provides coverage (percent area), count (number per 100 square centimeters) and size (equivalent circular diameter) for pinholes within the tissue sheet. The method uses a fluorescent ring illuminator to provide omni-directionality, high intensity and appropriate wavelength for incident-light detection of pinholes. Further, the method uses an image processing sequence of multiple sequential "openings" and "closings" to cluster appropriate sub-holes into a pinhole.

More specifically, a tissue sheet sample is placed on an auto-macrostage, resting on a Kreonite Mobil Studio macroviewer, under a 50 mm lens attached to a chalnicon scanner (TV camera). The sample is imaged over a black background and covered by a ⅛ inch thick glass plate. The key lighting is provided by a 6 inch Aristo Ring illuminator with a "cool" white bulb, providing incident omni-directional illumination. The variable neutral density filters (VNDFs) are used beforehand to "get close" to the proper white level response, with the auto-sensitivity function used during program execution then taking over to provide a "white level"=1.00. The autostage is moved to 25 adjacent field locations, each having a field size (live frame) of 15 mm. by 13 mm. The particular equipment to be used is: a Quantimet 970 Image Analysis System or equivalent; IDC HM1212 auto-macrostage; 50 mm El-Nikkor lens at f/5.6; variable neutral density filters (VNDFs); 20 mm. extension tube; Aristo Microlite M-II 6-inch fluorescent ring illuminator with cool white bulb; black photo-drape background; ⅛ inch covering plate glass; and a chalnicon scanner. Shading correction was set manually before program execution on high basis weight calendered computer paper.

The software routine to process the image is as follows:

```
COND =  DCI autostq; 6-inch ring lite, 2-inch above samp;
        50-mm EL-Nikkor lens, f/5.6; 20-mm extens tube;
        Glass over samp; shadcor on comp paper; black cloth
        background;
        Plate glass over samp; shadcr on paper; VNDF on lens.
        Enter specimen identity
        Scanner   (No. 2 Chalnicon LV - 0.00 SENS - 2.07 PAUSE)
        SUBRTN STANDARD
        Load Shading Corrector (pattern - PINHOL)
        Calibrate User Specified (Cal Value = 22.93
        microns per pixel)
        TOTCSANAR      := 0.
        TOTPERCAR      := 0.
        TOTANISOT      := 0.
        TOTFIELDS      := 0.
        PHOTO          := 0.
        AVEPERCAR      := 0.
        Pause Message
        DO YOU WANT TO TAKE PHOTO OF AVE FOV
        (1=Yes; 0 = NO)?
        Input PHOTO
        If PHOTO = 1, then
        Pause Message
        PLEASE ENTER AVE % AREA . . .
        Input AVEPERCAR
        Endif
        For SAMPLE = 1 to 1
        STAGEX         := 60000.
        STAGEY         := 120000.
        Stage Move (STAGEX, STAGEY)
        Pause Message
        PLEASE SET WHITE LEVEL AT 1.00 . . .
        Scanner (No. 2 Chalnicon LV = 0.00 SENS = 1.99 Pause)
        Pause Message
        PLEASE USE "DETECTION FOCUS"
        Detect 2D (Darker than 40, Delin PAUSE)
        STAGEX         := 60000.
        STAGEY         := 120000.
        Stage Move (STAGEX, STAGEY)
        StageScan      (      X   Y
                       scan origin STAGEX   STAGE Y
                       field size   15000.0   13300.0
                       no.of fields   5      5   )
        For FIELD
        Scanner (No. 2 Chalnicon AUTO-SENSITIVITY LV = 0.00)
        Image Frame is Standard Image Frame
        Live Frame Is Rectangle ( X: 126 Y: 120 W: 642, H: 570, )
        Detect 2D (Darker than 38, Delin )
        Amend          (CLOSE by 2)
        Amend          (OPEN by 2)
        Amend          (CLOSE by 12)
        Amend          (OPEN by 4)
        Measure field - Parameters into array FIELD
        PERCAREA : = 100 * FIELD AREAFRACT
        If PHOTO =1, then
        If PERCAREA >0.98000 * AVEPERCAR then
        If PERCAREA <1.0200 * AVEPERCAR then
        Pause Message
        PLEASE TAKE PHOTO . . .
        Pause
        Endif
        Endif
        Endif
        TOTPERCAR      := TOTPERCAR + 100. *FIELD
                          AREAFRACT
        TOTANISTOT     := TOTANISOT + 1./FIELD
                          ANISOTROPY
```

-continued

```
TOTFIELDS          := TOTFIELDS + 1.
Distribute COUNT vs PERCAREA (Units % AREA )
into GRAPH from 0.00 to 5.00 into 20 bins, differential
Measure feature AREA:   X.FCP   Y.FCP   LENGTH
into array FEATURE (of 1000 features and 5 parameters)
FEATURE CALC   := ( {4* AREA } /PI ) ^ 0.50000
Accept FEATURE CALC from   400. to 1.000000E+07
Distribution of COUNT v CALC (units microns )
from FEATURE in HISTO1 from 400.0 to 4000.
in 15 bins (LOG)
Stage Step
Next FIELD
Pause Message
PLEASE CHOOSE ANOTHER FIELD, OR "FINISH" . . .
Next
TOTCSANAR := TOTFIELDS *CL.FRARERA /
(1.[[#]] * 10. ^ 8. )
Print ""
Print [[#]] "TOTAL AREA SCANNED (sq cm)=",
TOTCSANAR
Print [**] ""
Print "AVE PERCENT COVERAGE =",
TOTPERCAR/TOTFIELDS
Print ""
Print ""
Print Distribution ( GRAPH, differential, ba(del)r chart,
scale = 0.00)
Print ""
Print ""
Print Distribution (HISTO1, differential, bar chart,
scale =   0.00)
For LOOPCOUNT = 1 to 5
Print ""
Next
END OF PROGRAM
```

The "Pinhole Coverage Index" is the arithmetic mean percent area of the sample surface area, viewed from above, which is covered or occupied by pinholes. It is represented by PERCAREA in the foregoing software program. For purposes of this invention, the Pinhole Coverage Index can be about 0.25 or less, more specifically about 0.20 or less, more specifically about 0.15 or less, and still more specifically from about 0.05 to about 0.15.

The "Pinhole Count Index" is the number of pinholes per 100 square centimeters that have an equivalent circular diameter (ECD) greater than 400 microns. It is represented by the total FEATURE COUNT in the histogram output from the foregoing software program, which is then manually divided by the TOTAL AREA SCANNED in the foregoing software program. For purposes of this invention, the Pinhole Count Index can be about 65 or less, more specifically about 60 or less, more specifically about 50 or less, more specifically about 40 or less, still more specifically from about 5 to about 50, and still more specifically from about 5 to about 40.

The "Pinhole Size Index" is the mean equivalent circular diameter (ECD) for all pinholes having an ECD greater than 400 microns. It is represented by CALC in the foregoing software program. For purposes of this invention, the Pinhole Size Index can be about 600 or less, more specifically about 500 or less, more specifically from about 400 to about 600, still more specifically from about 450 to about 550.

DETAILED DESCRIPTION OF THE DRAWINGS

Figure 1:
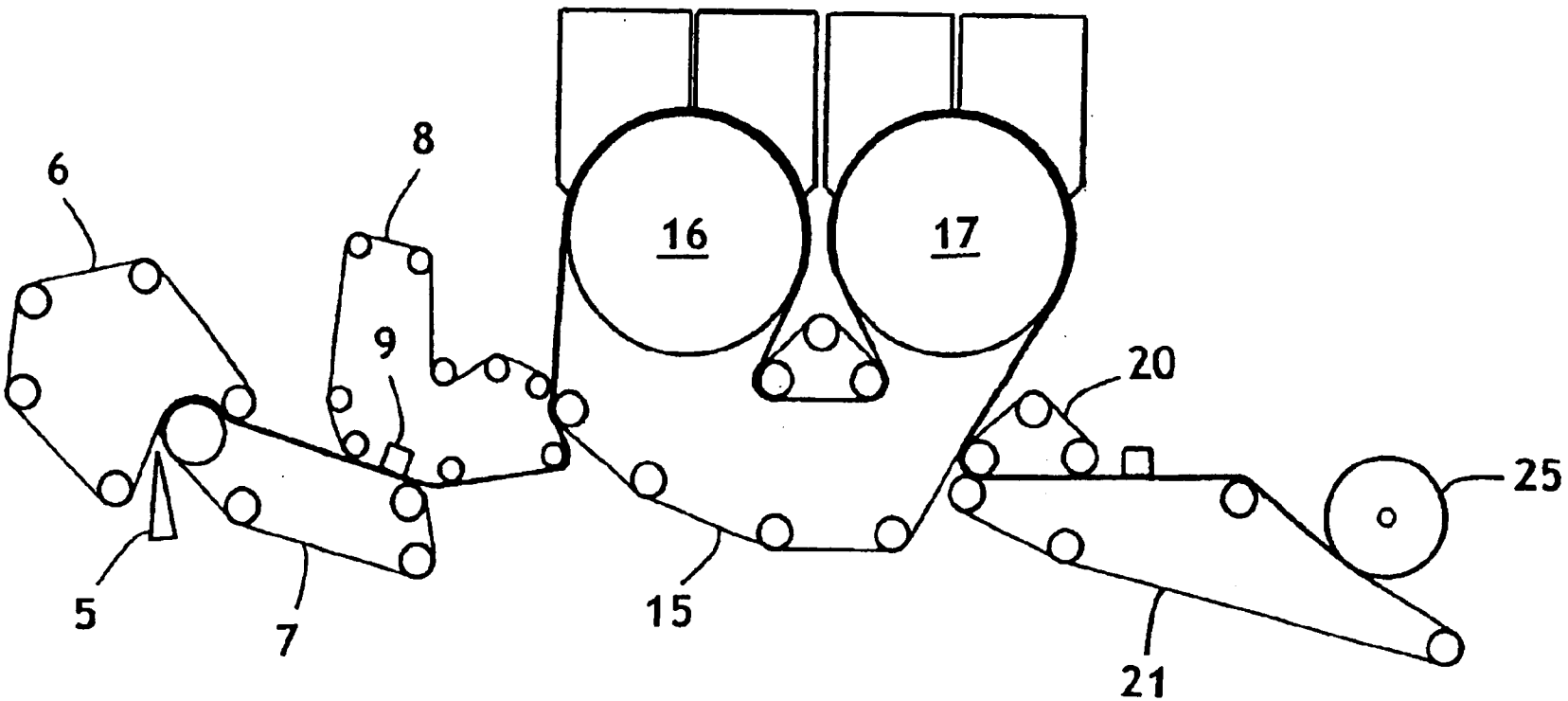
FIG. 1 is a schematic illustration of an uncreped throughdrying process suitable for making tissue sheets in accordance with this invention.

Referring to the Figures, the invention will be described in greater detail. In FIG. 1, shown is an uncreped throughdried tissue making process in which a multi-layered headbox 5 deposits an aqueous suspension of papermaking fibers between forming wires 6 and 7. The newly-formed web is transferred to a slower moving transfer fabric with the aid of at least one vacuum box 9. The level of vacuum used for the web transfers can be from about 3 to about 15 inches of mercury (76 to about 381 millimeters of mercury), preferably about 10 inches (254 millimeters) of mercury. The vacuum box (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum box(es).

The web is then transferred to a throughdrying fabric 15 and passed over throughdryers 16 and 17 to dry the web. The side of the web contacting the throughdrying fabric is referred to herein as the "fabric side" of the web. The opposite side of the web is referred to as the "air side" of the web. While supported by the throughdrying fabric, the web is final dried to a consistency of about 94 percent or greater. After drying, the sheet is transferred from the throughdrying fabric to fabric 20 and thereafter briefly sandwiched between fabrics 20 and 21. The dried sheet remains with fabric 21 until it is wound up at the reel 25. Thereafter, the tissue sheet can be unwound, calendered and converted into the final tissue product, such as a roll of bath tissue, in any suitable manner.

Figure 2A:
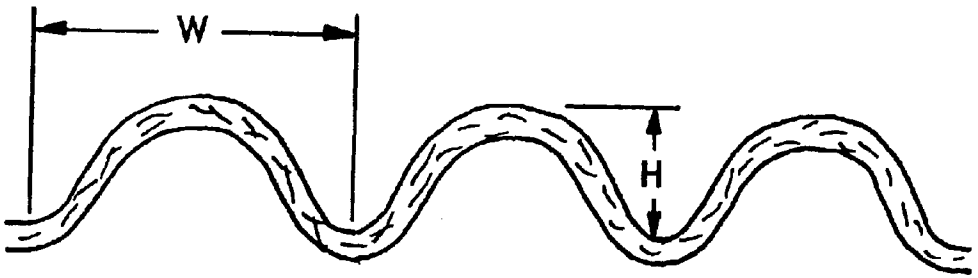
FIGS. 2A and 2B are schematic cross-sectional views of a tissue sheet in accordance with this invention, looking in the machine direction of the sheet, illustrating the concept of the Wide Wales.
Figure 2B:
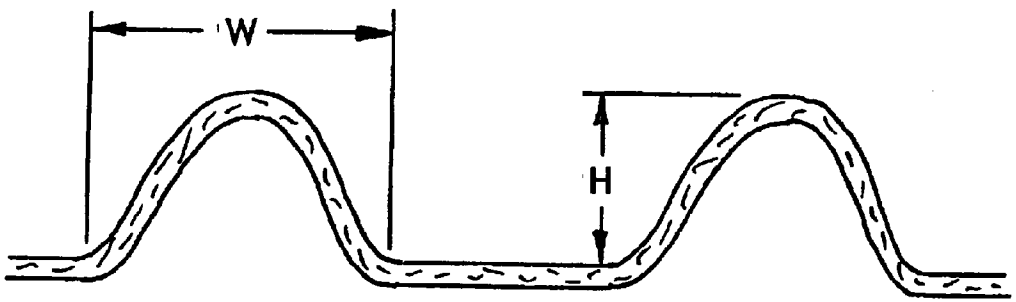

FIGS. 2A and 2B are schematic cross-sectional views of two tissue sheets in accordance with this invention. In both cases, the dimension "W" represents the width of a Wide Wale. The dimension "H" represents the height of a Wide Wale. FIG. 2B illustrates an embodiment in which there is a significant and measurable space between the bases of adjacent Wide Wales. For purposes of bath tissue, the Wide Wale spacing of FIG. 2A is advantageous in that the spacing between adjacent Wide Wales is minimal.

Referring generally to FIGS. 3–6, the throughdrying fabrics of this invention have a top surface and a bottom surface. During wet molding and throughdrying the top surface supports the wet tissue web. The wet tissue web conforms to the top surface, resulting in a tissue sheet appearance having three-dimensional topography corresponding to the three-dimensional topography of the top surface of the fabric.

Adjacent the bottom face, the fabric has a load-bearing layer which integrates the fabric while providing sufficient strength to maintain the integrity of the fabric as it travels through the throughdrying section of the paper machine, and yet is sufficiently porous to enable throughdrying air to flow through the fabric and the pulp web carried by it. The top face of the fabric has a sculpture layer consisting predominantly of parallel ridges which project substantially above the sub-level plane between the load-bearing layer and the sculpture layer. The ridges comprise multiple warps (strands substantially oriented in the machine direction) which float above the sub-level plane and group together to form ridges which are preferably wider and higher than the individual warps. The individual warp floats are interwoven with the load-bearing layer at their opposite ends. The ridges are spaced-apart transversely of the fabric, so that the sculpture layer exhibits valleys between the ridges. The length, diameter, and spacing of the individual warp floats affect the height, width, and cross sectional shape of the ridges and valleys.

Figure 3A:
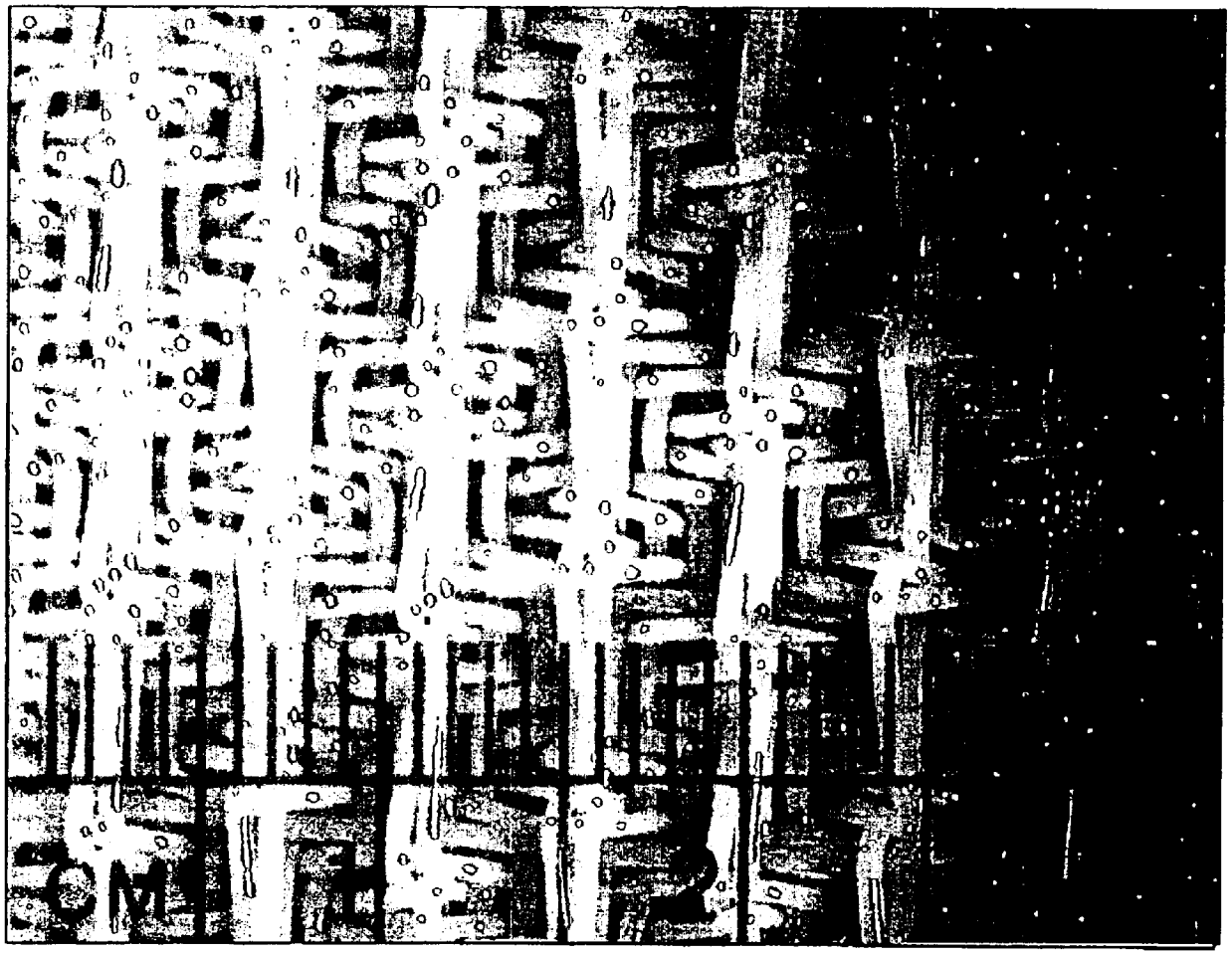
FIG. 3A is a plan view photograph of a throughdrying fabric in accordance with this invention, illustrating the MD ridges.
Figure 3B:
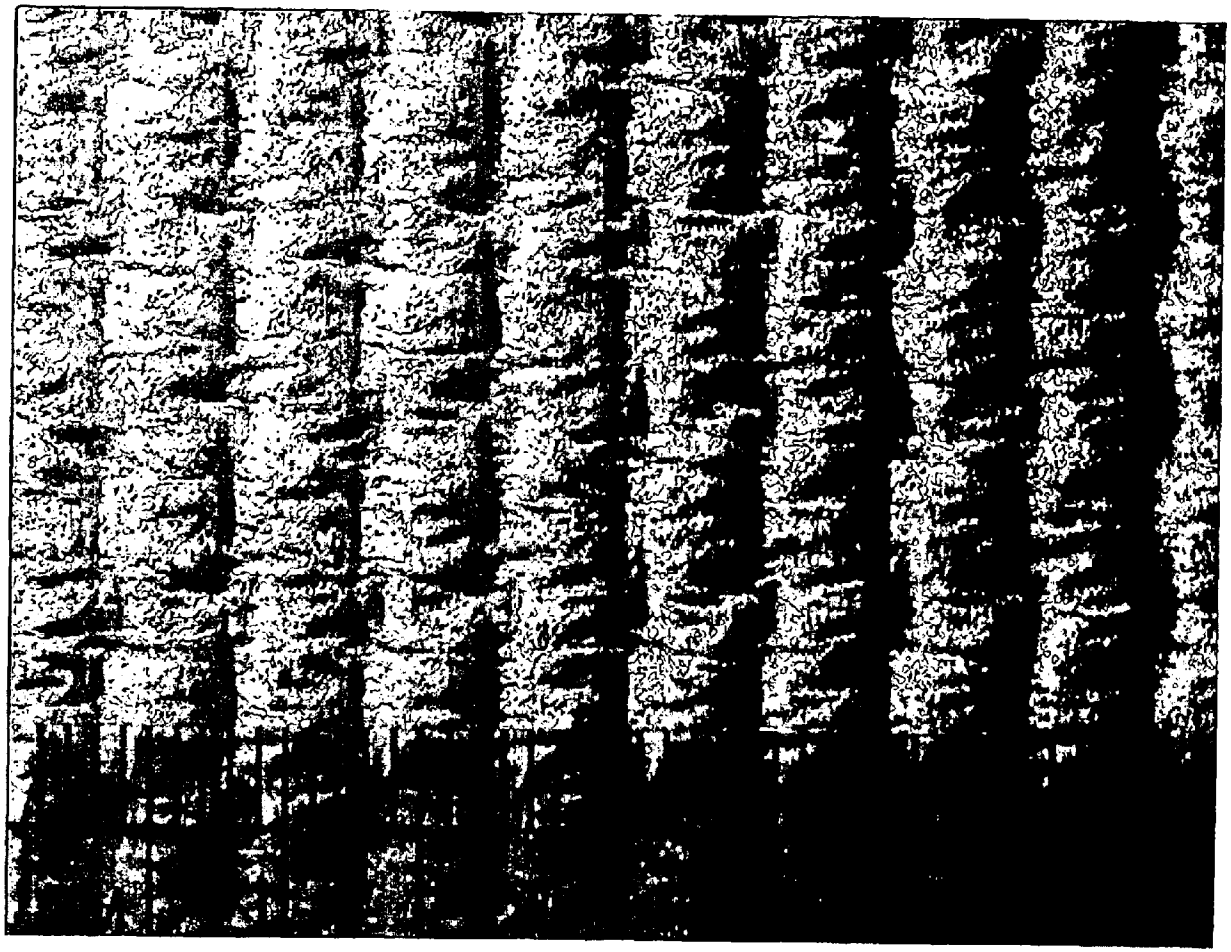
FIG. 3B is a plan view photograph of the fabric side surface of an uncreped throughdried tissue sheet in accordance with this invention made using the fabric of FIG. 3A, illustrating the Wide Wales in the sheet.
Figure 3C:
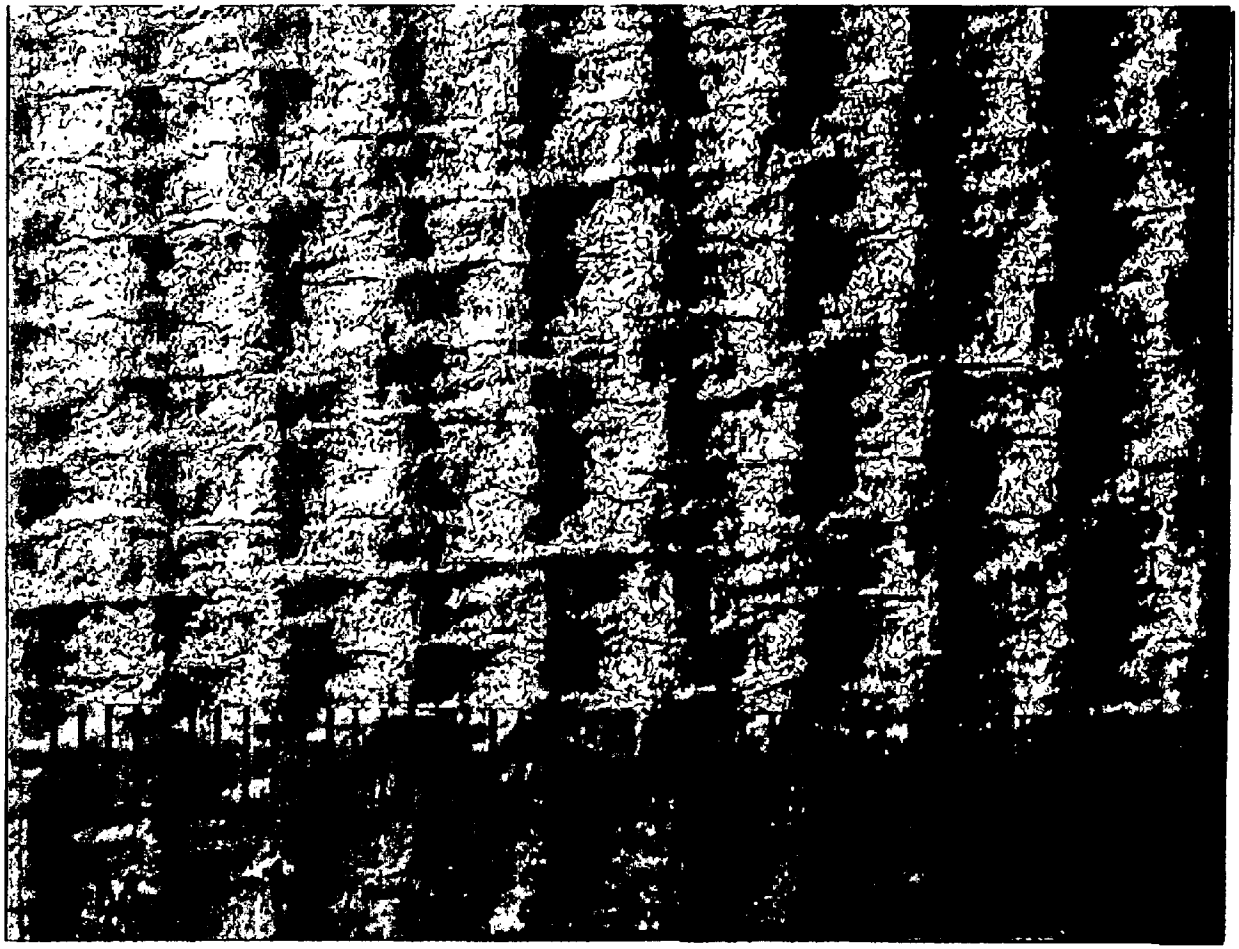
FIG. 3C is a plan view photograph of the air side surface of the uncreped throughdried tissue sheet of FIG. 3B, further illustrating the Wide Wale structure.

FIG. 3A is a plan view photograph of Voith Fabrics t1203-8, a throughdrying fabric in accordance with this invention. FIG. 3B is a photograph of the fabric side of a tissue sheet made with the t1203-8. FIG. 3C is a photograph of the air side of a tissue sheet made with the t1203-8.

Figure 4A:
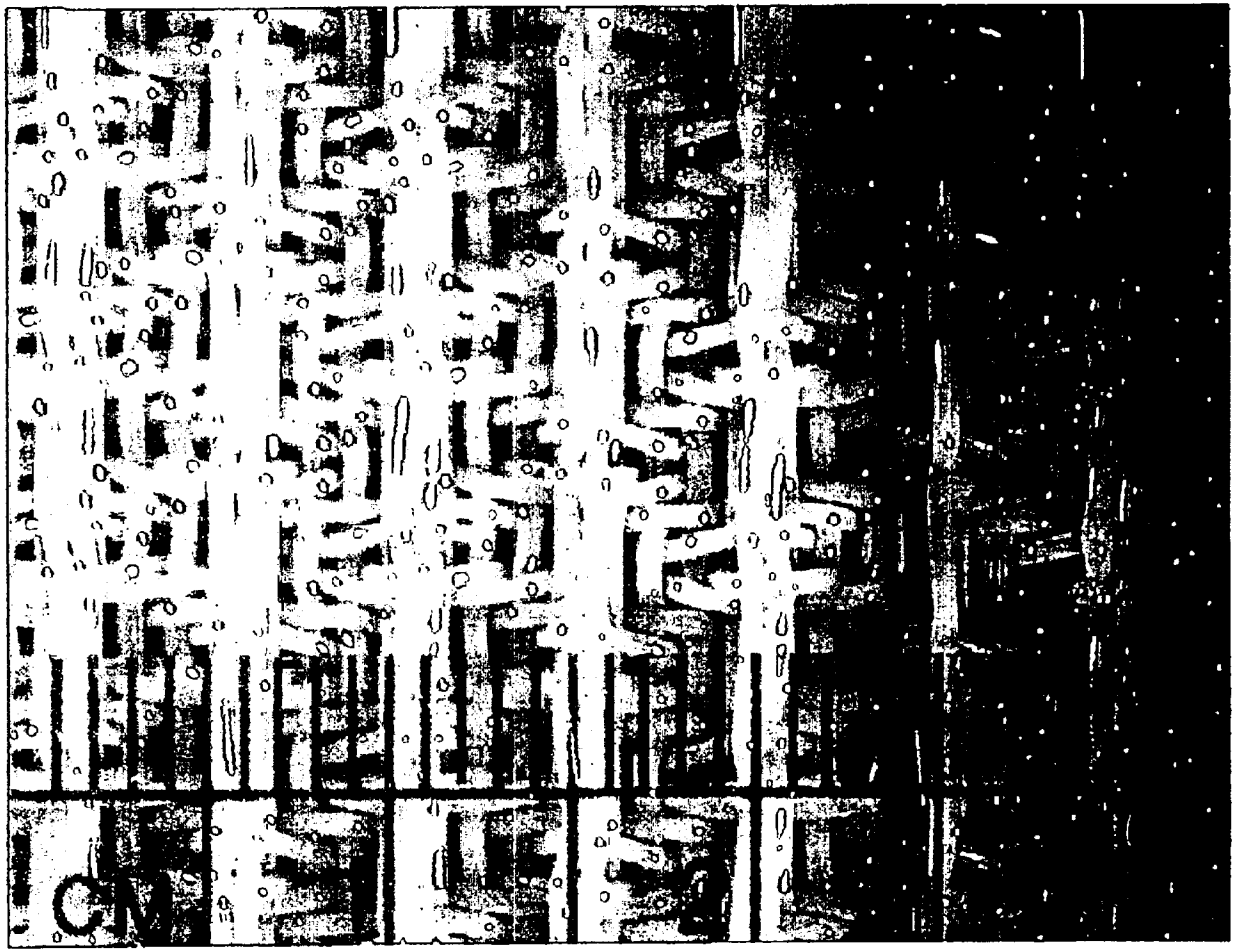
FIG. 4A is a plan view photograph of another throughdrying fabric in accordance with this invention.
Figure 4B:
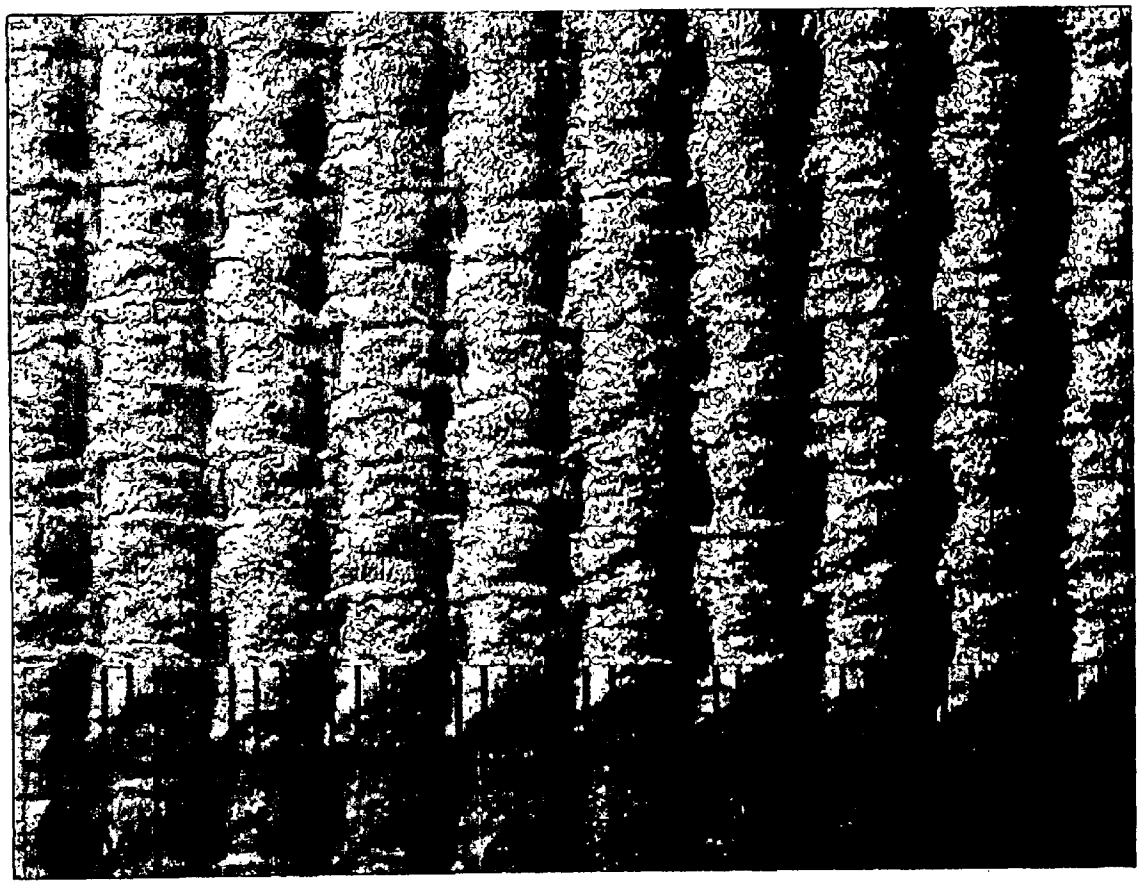
FIG. 4B is a plan view photograph of the fabric side surface of an uncreped throughdried tissue sheet in accordance with this invention made using the fabric of FIG. 4A.
Figure 4C:
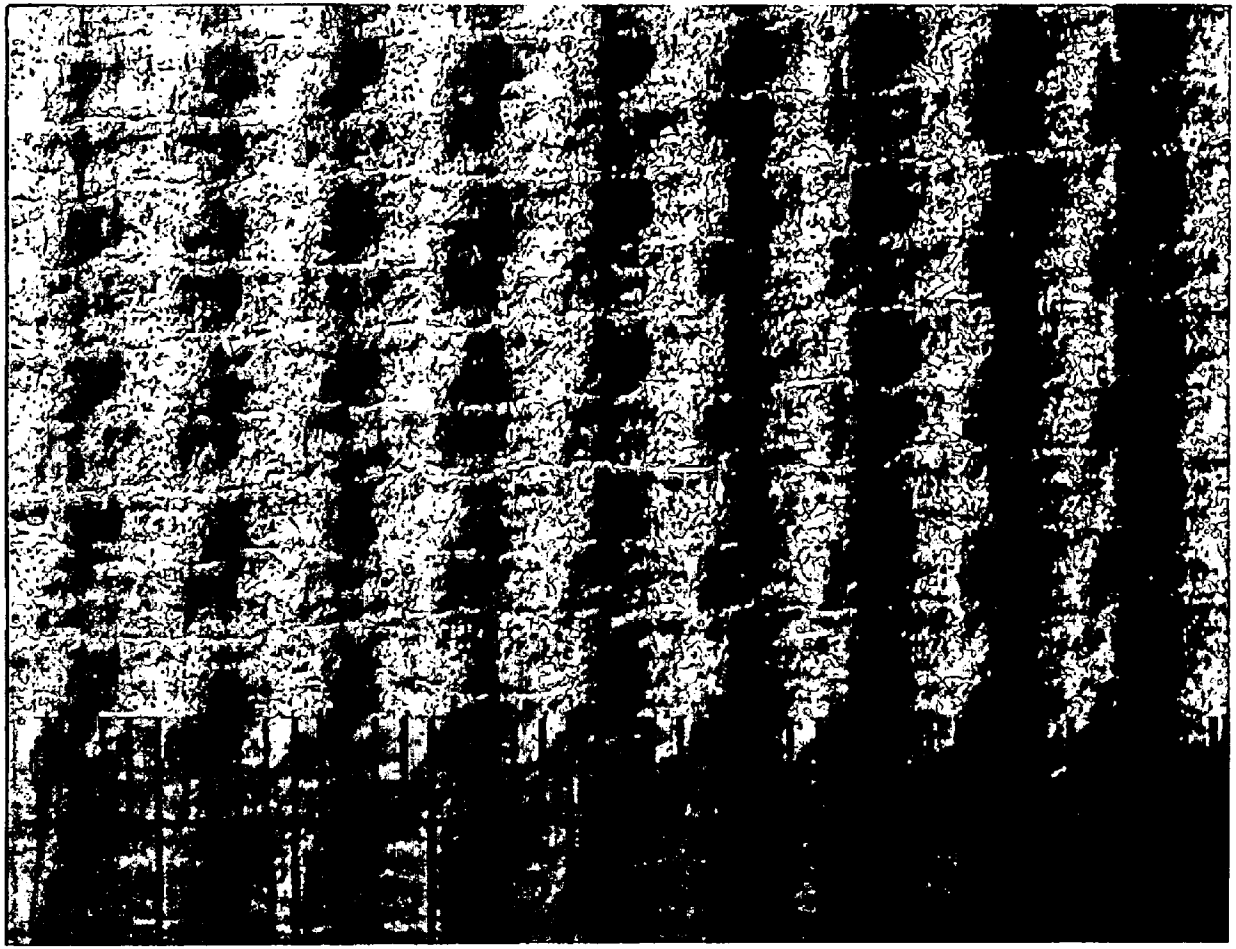
FIG. 4C is a plan view photograph of the air side surface the uncreped throughdried tissue sheet of FIG. 4B.

FIG. 4A is a plan view photograph of Voith Fabrics t1203-6, a throughdrying fabric in accordance with this invention. FIG. 4B is a photograph of the fabric side of a tissue sheet made with the t1203-6. FIG. 4C is a photograph of the air side of a tissue sheet made with the t1203-6.

Figure 5A:
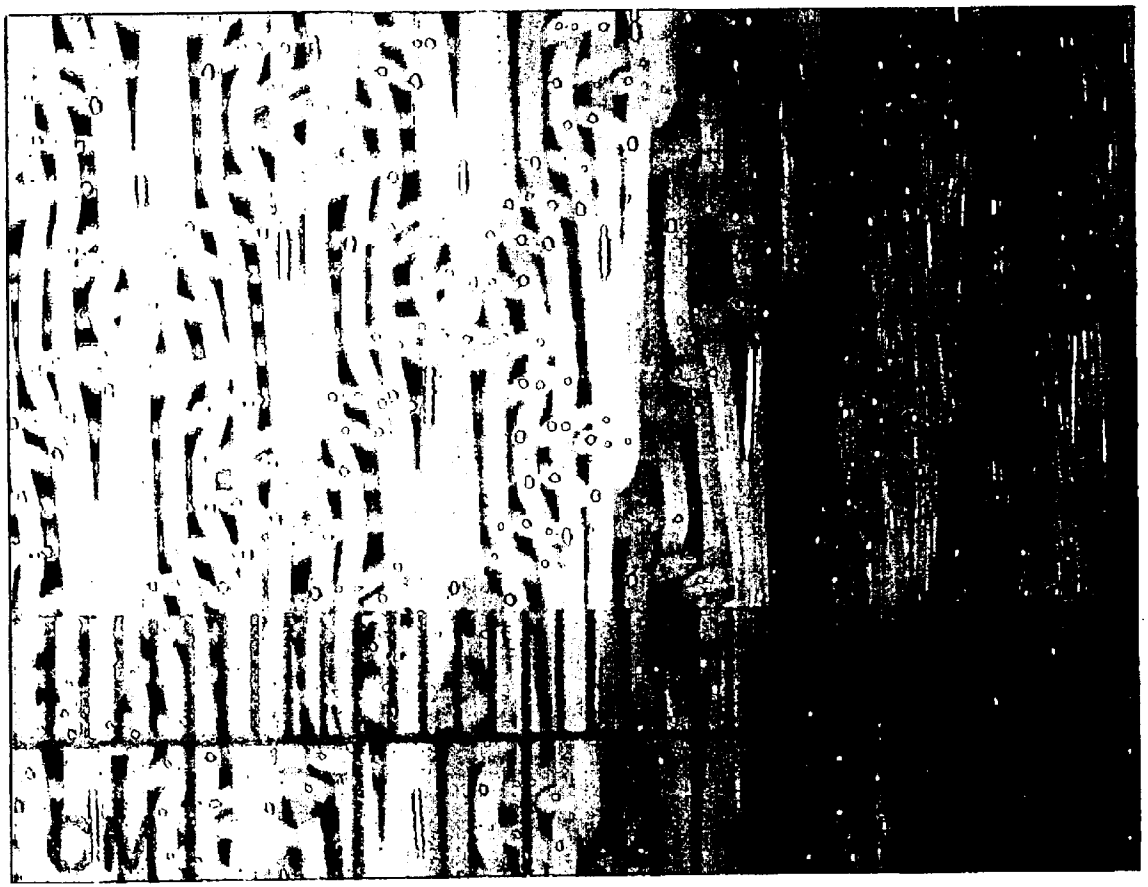
FIG. 5A is a plan view photograph of another throughdrying fabric in accordance with this invention.
Figure 5B:
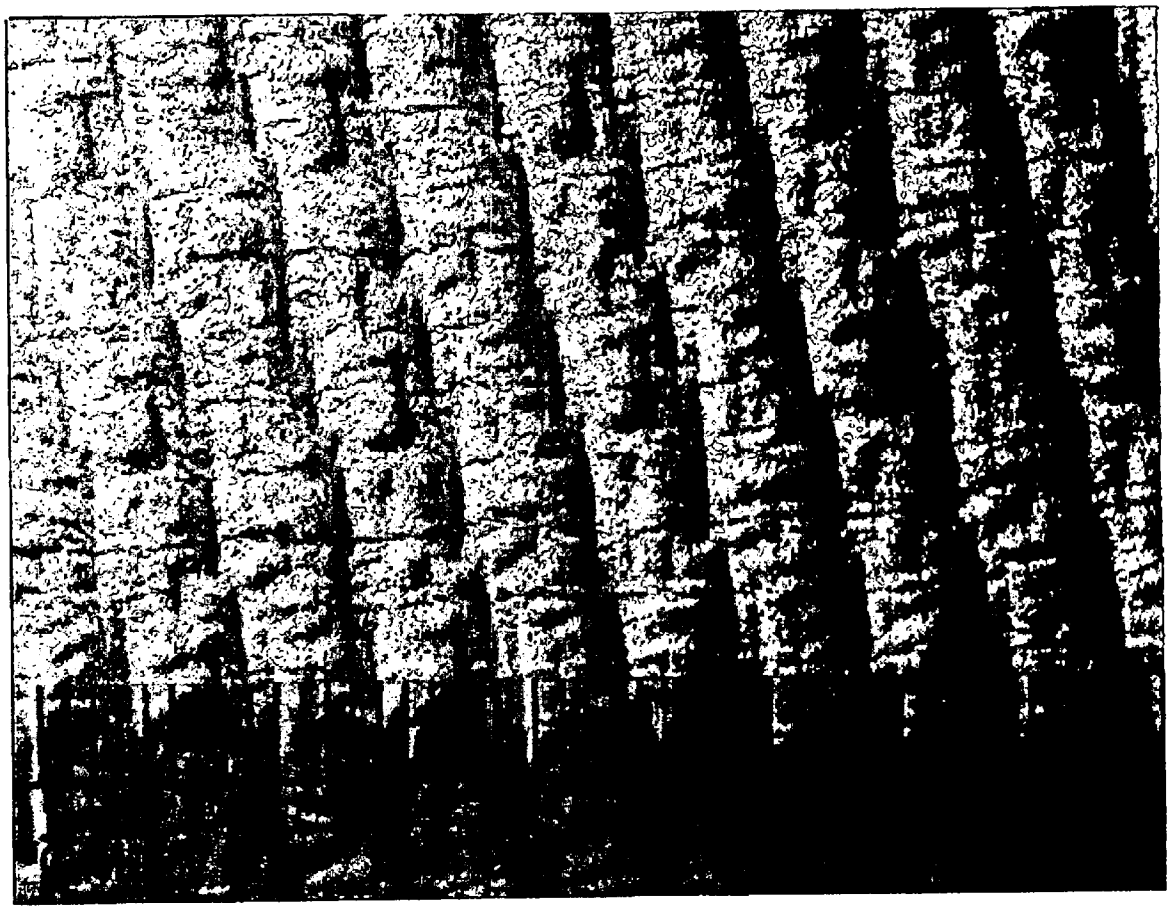
FIG. 5B is a plan view photograph of the fabric side surface of an uncreped throughdried tissue sheet in accordance with this invention made using the fabric of FIG. 5A.
Figure 5C:
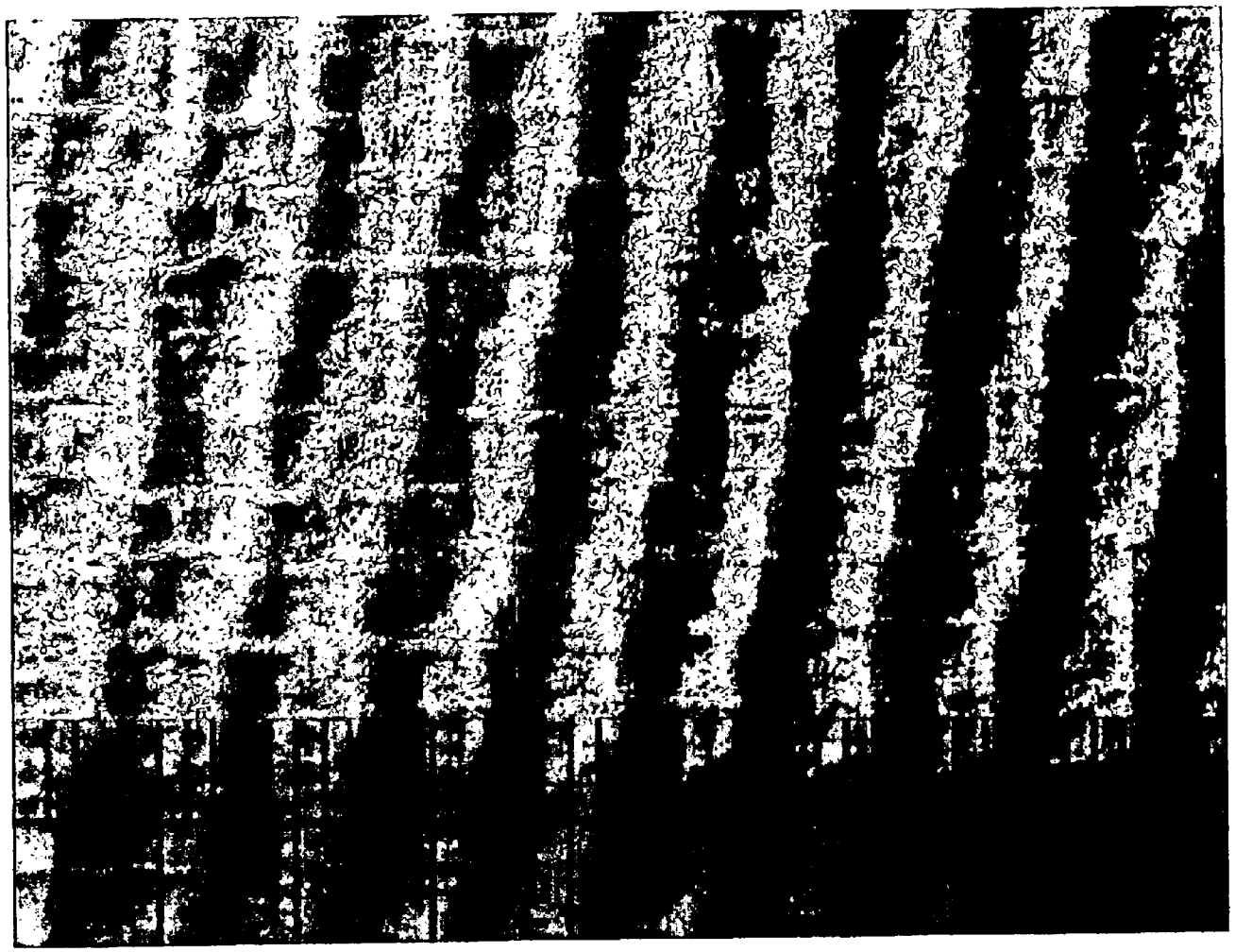
FIG. 5C is a plan view photograph of the air side surface the uncreped throughdried tissue sheet of FIG. 5B.

FIG. 5A is a plan view photograph of Voith Fabrics t1203-7, a throughdrying fabric in accordance with this invention. FIG. 5B is a photograph of the fabric side of a tissue sheet made with the t1203-7. FIG. 5C is a photograph of the air side of a tissue sheet made with the t1203-7.

Figure 6A:
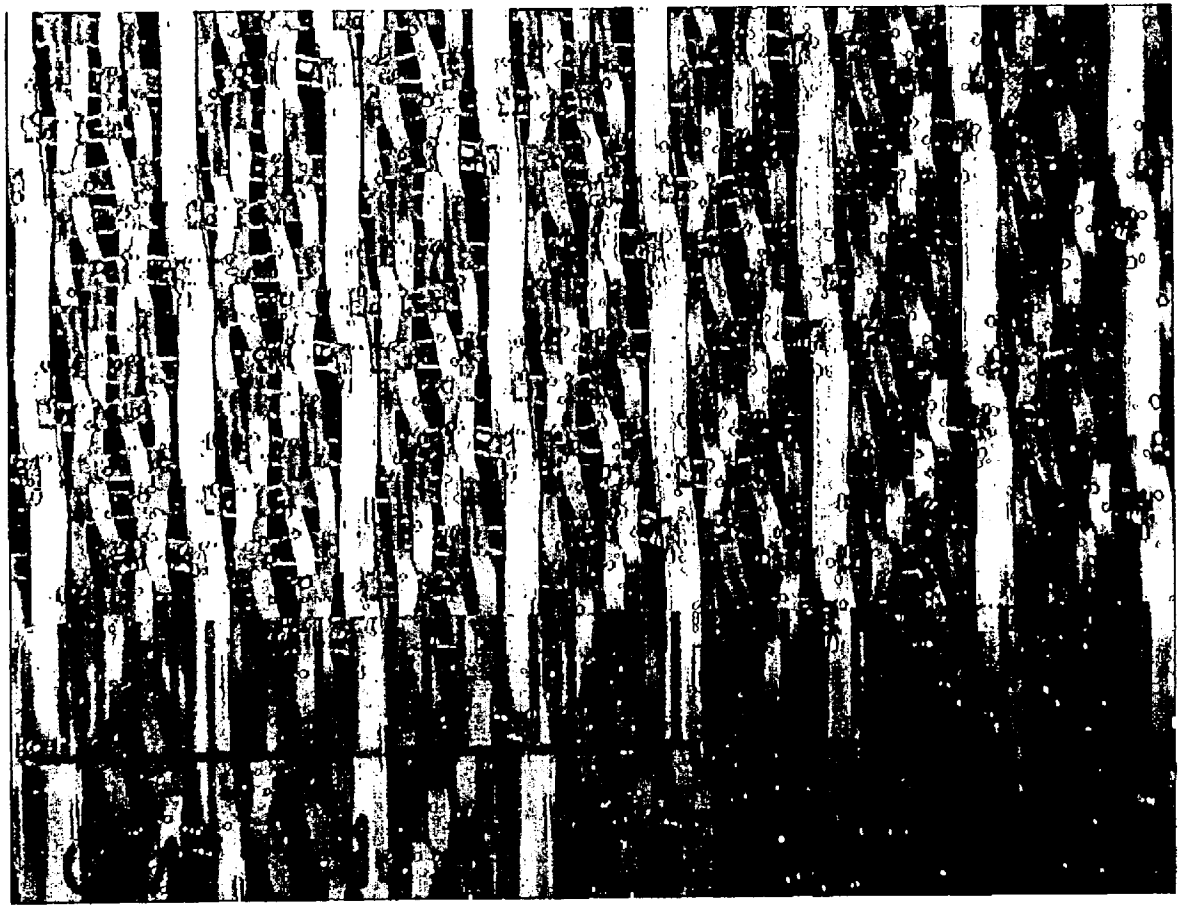
FIG. 6A is a plan view photograph of another throughdrying fabric in accordance with this invention.
Figure 6B:
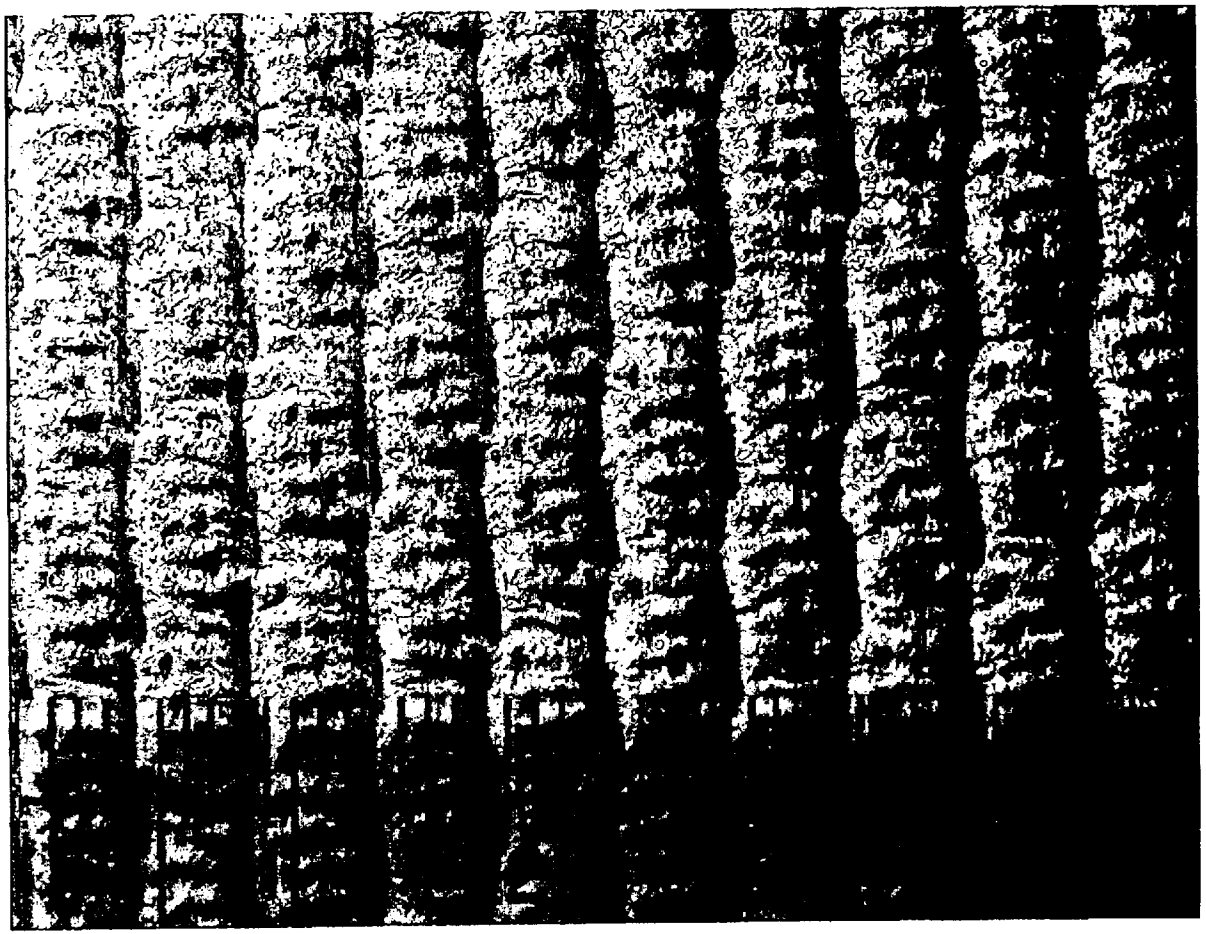
FIG. 6B is a plan view photograph of the fabric side surface of an uncreped throughdried tissue sheet in accordance with this invention made using the fabric of FIG. 6A.
Figure 6C:
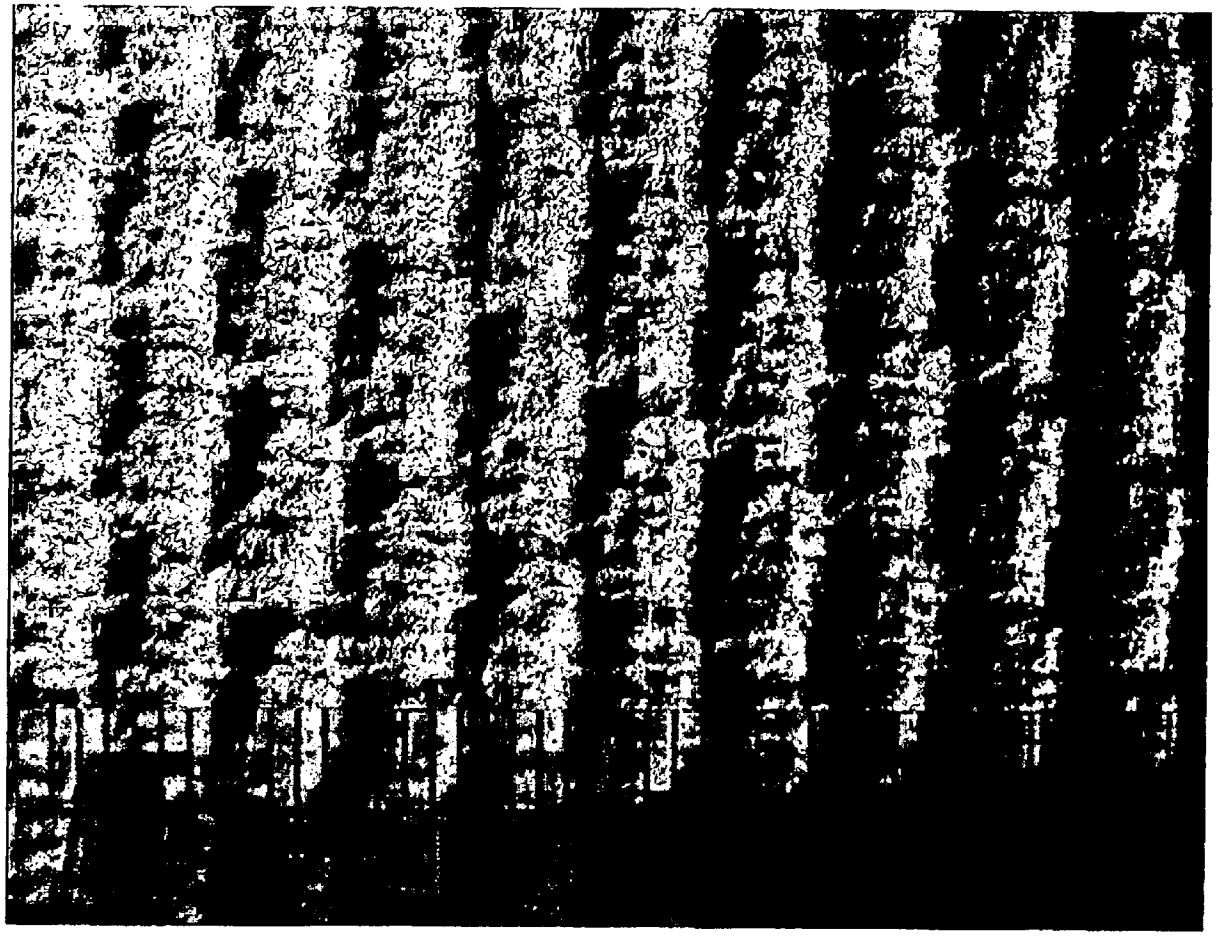
FIG. 6C is a plan view photograph of the air side surface the uncreped throughdried tissue sheet of FIG. 6B.

FIG. 6A is a plan view photograph of Voith Fabrics t2405-2, a throughdrying fabric in accordance with this invention. FIG. 6B is a photograph of the fabric side of a tissue sheet made with the t2405-2. FIG. 6C is a photograph of the air side of a tissue sheet made with the t2405-2.

EXAMPLES

Example 1

In order to further illustrate this invention, a tissue sheet suitable for single-ply bath tissue was made as described in FIG. 1. More specifically, a three-layered tissue sheet was made in which the two outer layers comprised a debonded mixture of Bahia Sul eucalyptus fibers and broke fibers and the center layer comprised refined northern softwood kraft (NSWK) fibers. Broke fibers comprised 15 percent of the sheet on a dry fiber basis.

Prior to formation, the outer layer fibers were pulped for 15 minutes at 10 percent consistency and diluted to about 2.5 percent consistency after pulping. A debonder (ProSoft TQ1003) was added to the outer layer pulp in the amount of 4.1 kilograms of debonder per tonne of outer layer dry fiber.

The NSWK fibers were pulped for 30 minutes at 4 percent consistency and diluted to about 2.7 percent consistency after pulping. The overall layered sheet weight was split 34 percent to the center layer on a dry fiber basis and 33 percent to each of the outer layers. The center layer was refined to levels required to achieve target strength values, while the outer layers provided surface softness and bulk. Parez 631 NC was added to the center layer at 4.0 kilograms per tonne of center layer dry fiber.

A three-layer headbox was used to form the wet web with the refined NSWK stock in the center layer of the headbox. Turbulence-generating inserts recessed about 3.5 inches (89 millimeters) from the slice and layer dividers extending about 1 inch (25 millimeters) beyond the slice were employed. The net slice opening was about 0.9 inch (23 millimeters). The water flows in the headbox layers were split 28.5 percent to each of the outer layers and 43 percent to the center layer. The consistency of the stock fed to the headbox was about 0.1 weight percent.

The resulting three-layered sheet was formed on a twin-wire, suction form roll, former, with the outer forming fabric being an Asten 867A, and the inner forming fabric being a Voith Fabrics 2164-33B. The speed of the forming fabrics was 2048 feet per minute (10.4 meters per second). The newly-formed web was then dewatered to a consistency of about 27–29 percent using vacuum suction from below the forming fabric before being transferred to the transfer fabric, which was traveling at 1600 feet per minute (8.13 meters per second) (28 percent rush transfer). The transfer fabric was a Voith Fabrics t807-1. A vacuum shoe pulling about 10 inches (254 mm) of mercury rush trafsfer vacuum was used to transfer the web to the transfer fabric.

The web was then transferred to a Voith Fabrics t1203-8 throughdrying fabric (FIG. 3A). A vacuum transfer roll was used to wet mold the sheet into the throughdrying fabric at about 3.5 inches (89 mm) of mercury wet molding vacuum. The throughdrying fabric was traveling at a speed of about 8.13 meters per second. The web was carried over a pair of Honeycomb throughdryers fabric operating at a temperature of about 380° F. (193° C.) and dried to final dryness of about 98 percent consistency.

Examples 2–4

Tissue sheets were made as described in Example 1, except the wet molding vacuum was changed. (See Table 1 below.)

Examples 5–9

Bath tissues were made as described in Example 1, except that the throughdrying fabric was a Voith Fabrics t1203-6 (FIG. 4A), the center layer split was 30 percent, and the wet molding vacuum was as set forth in Table 1 below.

TABLE 1

| Example | Wet Molding Vacuum mm Hg | Basis wt gsm | Caliper μm | GMT g/7.62 cm | GMM/GMT km/kg | MD Tensile/ CD Tensile | MD Tensile Stretch % | MD Tensile Total Energy Absorbed (GmCm/SqCm) |
|---|---|---|---|---|---|---|---|---|
| 1 | 89 | 33.1 | 754 | 1066 | 4.44 | 0.96 | 25.4 | 15.0 |
| 2 | 152 | 33.3 | 1008 | 999 | 4.56 | 1.00 | 24.9 | 15.0 |
| 3 | 254 | 33.1 | 1067 | 958 | 4.15 | 0.99 | 24.7 | 14.3 |
| 4 | 305 | 33.1 | 991 | 862 | 4.47 | 1.14 | 24.1 | 13.4 |
| 5 | 102 | 32.9 | 1044 | 1070 | 4.62 | 0.97 | 23.8 | 15.6 |
| 6 | 152 | 32.9 | 1176 | 931 | 4.35 | 1.17 | 23.9 | 15.3 |
| 7 | 203 | 32.8 | 1267 | 892 | 4.82 | 1.23 | 23.8 | 15.8 |
| 8 | 254 | 33.5 | 1285 | 843 | 4.61 | 1.34 | 24.4 | 16.0 |

| Example | CD Tensile Stretch % | CD Tensile Total Energy Absorbed (GmCm/SqCm) | wale width mm | wale frequency 1/cm | Pinhole Coverage Index % | Pinhole Count Index count | Pinhole Size Index μm |
|---|---|---|---|---|---|---|---|
| 1 | 8.8 | 5.4 | 4.76 | 2.10 | 0.112 | 26 | 477 |
| 2 | 9.9 | 5.5 | 4.76 | 2.10 | 0.075 | 8 | 453 |
| 3 | 11.6 | 6.3 | 4.76 | 2.10 | 0.098 | 20 | 533 |
| 4 | 11.5 | 5.3 | 4.76 | 2.10 | 0.143 | 38 | 538 |
| 5 | 11.3 | 6.6 | 4.76 | 2.10 | 0.068 | 16 | 480 |
| 6 | 11.7 | 5.2 | 4.76 | 2.10 | 0.102 | 24 | 522 |
| 7 | 11.7 | 4.4 | 4.76 | 2.10 | 0.332 | 79 | 622 |
| 8 | 13.0 | 4.5 | 4.76 | 2.10 | 0.561 | 144 | 633 |

It will be appreciated that the foregoing examples, given for purposes of illustration, are not to be constructed as limiting the scope of the invention, which is defined by the following claims and all equivalents thereto.

We claim:

1. A continuous method of making bath tissue and paper towels on the same papermaking machine comprising:

(a) forming a first tissue web having a first basis weight;

(b) transferring the first tissue web to a throughdrying fabric having continuous machine-direction ridges separated by valleys, wherein the height of the ridges is from about 0.5 to about 3.5 millimeters, the width of the ridges is about 0.3 centimeter or greater and the frequency of the ridges in the cross-machine direction is from about 0.2 to about 3 per centimeter;

(c) throughdrying the first tissue web while supported by the throughdrying fabric;

(d) winding the tissue first tissue web into a first parent roll;

(e) converting the first parent roll into paper toweling;

(f) forming a second tissue web having a second basis weight which is less than the first basis weight;

(g) transferring the second tissue web to the same throughdrying fabric of step (b);

(h) throughdrying the second tissue web while supported by the throughdrying fabric;

(i) winding the dried second tissue web into a second parent roll; and (j) converting the second parent roll into bath tissue.

2. The method of claim 1 wherein the height of the ridges is from about 0.6 to about 2.0 millimeters.

3. The method of claim 1 wherein the height of the ridges is from about 1.0 to about 2.0 millimeters.

4. The method of claim 1 wherein the height of the ridges is from about 1.0 to about 1.5 millimeters.

* * * * *